US011574606B2

(12) United States Patent
Woo

(10) Patent No.: US 11,574,606 B2
(45) Date of Patent: Feb. 7, 2023

(54) ORGANIC LIGHT EMITTING DIODE DISPLAY DEVICE

(71) Applicant: Samsung Display Co., Ltd., Yongin-si (KR)

(72) Inventor: Jong Seok Woo, Daejeon (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/459,421

(22) Filed: Aug. 27, 2021

(65) Prior Publication Data

US 2021/0390912 A1 Dec. 16, 2021

Related U.S. Application Data

(62) Division of application No. 16/582,007, filed on Sep. 25, 2019, now Pat. No. 11,138,941.

(30) Foreign Application Priority Data

Sep. 28, 2018 (KR) ..... 10-2018-0115869

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01)

(58) Field of Classification Search
CPC .. G09G 3/3291; G09G 3/3258; G09G 3/3208; G09G 3/3233
See application file for complete search history.

(56) References Cited

U.S. PATENT DOCUMENTS

| | | | | |
|---|---|---|---|---|
| 10,304,372 | B2 * | 5/2019 | Kim | G09G 3/3688 |
| 10,388,228 | B2 | 8/2019 | Kim et al. | |
| 10,978,003 | B2 | 4/2021 | Kim et al. | |
| 2014/0210807 | A1 * | 7/2014 | Kim | H01L 27/3265 345/212 |
| 2017/0301293 | A1 | 10/2017 | Zhu et al. | |
| 2017/0337877 | A1 | 11/2017 | Kim et al. | |
| 2017/0345371 | A1 | 11/2017 | Son et al. | |
| 2018/0172397 | A1 * | 6/2018 | Zook | F41C 27/00 |
| 2018/0188877 | A1 | 7/2018 | Cai et al. | |

FOREIGN PATENT DOCUMENTS

| | | |
|---|---|---|
| KR | 1998-014193 | 5/1998 |
| KR | 10-0637227 | 10/2006 |
| KR | 10-0669471 | 1/2007 |
| KR | 10-2016-0114246 | 10/2016 |
| KR | 10-2017-0019022 | 2/2017 |
| KR | 10-2017-0131758 | 11/2017 |

* cited by examiner

*Primary Examiner* — Lixi C Simpson
(74) *Attorney, Agent, or Firm* — Kile Park Reed & Houtteman PLLC

(57) ABSTRACT

An organic light emitting diode display includes a display area including a pixel for receiving an emitting signal and emitting light, and first and second emitting signal generators provided on respective sides of the display area. Each of the first and second emitting signal generators includes a plurality of emitting signal stages. Each of the plurality of emitting signal stages are respectively connected to n-numbered pixel rows, and two adjacent emitting signal stages to which the n-numbered adjacent pixel rows are connected are in a same one of the first and second emitting signal generators.

6 Claims, 12 Drawing Sheets

ORGANIC LIGHT EMITTING DIODE DISPLAY DEVICE

CROSS-REFERENCE TO RELATED APPLICATION(S)

This is a divisional application of U.S. patent application Ser. No. 16/582,007, filed Sep. 25, 2019 (now U.S. Pat. No. 11,138,941), the disclosure of which is incorporated herein by reference in its entirety. U.S. patent application Ser. No. 16/582,007 claims priority to and benefit of Korean Patent Application No. 10-2018-0115869 under 35 U.S.C. § 119, filed on Sep. 28, 2018, in the Korean Intellectual Property Office, the entire contents of which are incorporated herein by reference.

BACKGROUND

1. Field

The present disclosure relates to an organic light emitting diode display, and, in particular, relates to an organic light emitting diode display including an emitting signal generator.

2. Description of the Related Art

Organic light emitting diode displays have a self-luminance characteristic, i.e., do not require a separate light source, resulting in reduced thickness and weight. Further, the organic light emitting diode display provide low power consumption, high luminance, and a high reaction speed.

Each pixel of organic light emitting diode may respectively emit light. For this purpose, an emitting signal generator transmits an emitting signal to each pixel so that the organic light emitting diode may emit light.

SUMMARY

One or more embodiments provides an organic light emitting diode display including a display area including a pixel for receiving an emitting signal and emitting light, and first and second emitting signal generators provided on respective sides of the display area. Each of the first and second emitting signal generators include a plurality of emitting signal stages. Each of the plurality of emitting signal stages is connected to n-numbered pixel rows, and two adjacent emitting signal stages to which the n-numbered adjacent pixel rows are connected are included in a same one of the first and second emitting signal generators.

The organic light emitting diode display may further include two clock signal wires for applying clock signals to the first and second emitting signal generators.

The emitting signal stages may respectively include two clock signal input ends, the two clock signal wires may be respectively connected to the two clock signal input ends, the same may be formed on a same one of the first and second emitting signal generators, and the clock signal wires connected to the two clock signal input ends of the adjacent emitting signal stage may be different from each other.

N may be an integer that is equal to or greater than 1, and the n-numbered pixel rows may emit light together. The organic light emitting diode display may further include first and second scan signal generators provided on respective sides of the display area between the display area and the first and second emitting signal generators. The first and second scan signal generators may apply a gate-on voltage three times for one frame.

The emitting signal stages may respectively include a first clock signal input end and a second clock signal input end for receiving the two clock signals, a control end for receiving the emitting signal from the emitting signal stage at a previous-end, and an output end for outputting the emitting signal.

Capacitance of the first clock signal input end may be different from capacitance of the second clock signal input end by equal to or greater than a predetermined level.

The emitting signal stages may respectively have a high-level output unit and a low-level output unit, and the high-level output unit may output a high voltage to the output end and the low-level output unit may output a low voltage to the output end.

The high-level output unit may be controlled by a voltage at a first node, and a first-node first controller and a first-node second controller for controlling the voltage at the first node may be further included.

The first-node first controller may change the voltage at the first node to a high voltage, and the first-node second controller may change the voltage at the first node to a low voltage of the clock signal.

The first-node second controller may be controlled by a voltage at a third node, and a third node controller for controlling the voltage at the third node may be further included.

The third node controller may include a fourth transistor and a fifth transistor, the fifth transistor may change the voltage at the third node to a low voltage, and the fourth transistor may change the voltage at the third node to a high voltage of the clock signal.

The low-level output unit may be controlled by a voltage at a second node, and a second-node first controller for controlling the voltage at the second node may be further included.

The second-node first controller may change the voltage at the second node to a high voltage or a low voltage of the emitting signal of the emitting signal stage at a previous-end.

The organic light emitting diode display may further include a second-node second controller for controlling the voltage at the second node together with the second-node first controller, wherein the second-node second controller may not allow the voltage of the second node to be changed to a low voltage when the second node is a high voltage.

One or more embodiments provides an organic light emitting diode display including a display area including a pixel for receiving an emitting signal and emitting light, and first and second emitting signal generators provided on respective sides of the display area. The first and second emitting signal generators each include a plurality of emitting signal stages. Each of the plurality of emitting signal stages includes two clock signal input ends having different capacitance values, and a matching capacitor connected to the clock signal input end with lower capacitance from among the two clock signal input ends is further included.

The two adjacent emitting signal stages may be included in the same one of the first and second emitting signal generators.

The two adjacent emitting signal stages may be included in the first and second emitting signal generators.

The emitting signal stages may be respectively connected to n-numbered pixel rows, the n may be an integer that is equal to or greater than 1, and the n-numbered pixel rows may emit light simultaneously.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
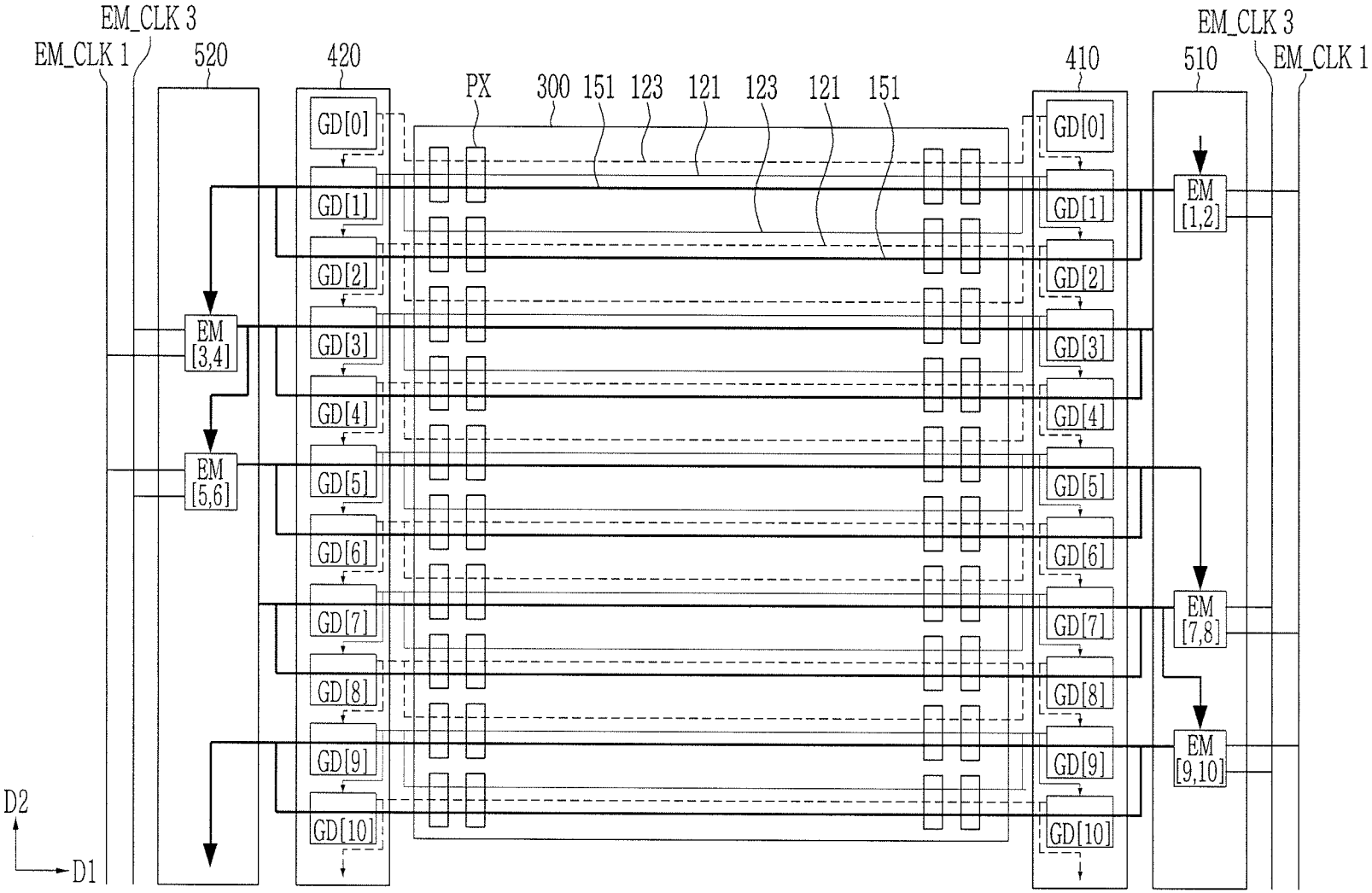
FIG. 1 illustrates an organic light emitting diode display according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

The drawings and description are to be regarded as illustrative in nature and not restrictive. Like reference numerals designate like elements throughout the specification.

An organic light emitting diode display according to an exemplary embodiment will now be described with reference to FIG. 1. FIG. 1 shows an organic light emitting diode display according to an exemplary embodiment. The organic light emitting diode display includes a display panel including a substrate, and the display panel is divided into a display area 300 and a non-display area in a periphery of the display area 300.

The display area 300 includes a plurality of pixels PX and the non-display area includes various drivers for driving the pixels PX. In FIG. 1, a pair of scan signal generators 410 and 420 and a pair of emitting signal generators 510 and 520 are formed on respective sides of the display area 300. The scan signal generators 410 and 420 are provided in the non-display area provided near the display area 300, and the emitting signal generators 510 and 520 are formed outside the same, i.e., further from the display area 300. Drivers for applying a data voltage, a driving voltage, a driving low voltage, an initialization voltage, and so forth to the pixels PX may further be provided in the non-display area, details of which are not relevant to embodiments described below.

In the display area 300, a plurality of pixels PX are arranged in a row direction (or a first direction D1) and a column direction (or a second direction D2). The pixel PX of the organic light emitting diode display generally includes a pixel circuit portion on the substrate and a light-emitting device on the pixel circuit portion. The light-emitting device includes an organic light emitting diode that receives a current from the pixel circuit portion and changes an emitting degree according to a size of the current.

The pixel PX shown in FIG. 1 is illustrated with reference to the pixel circuit portion connected to a scan line 121, a previous-end scan line 123, and an emitting signal line 151. The pixel PX is connected to the scan line 121, the previous-end scan line 123, and the emitting signal line 151. The scan line 121, the previous-end scan line 123, and the emitting signal line 151 extend in the first direction D1. The pixel PX is connected to the data line for transmitting the data voltage to the pixel PX. The data line extends in the second direction D2 perpendicular to the first direction D1.

The scan signal generators 410 and 420 may include a first scan signal generator 410 in the non-display area on a right side of the display area 300 and a second scan signal generator 420 in the non-display area on a left side thereof. The scan signal generators 410 and 420 respectively include a plurality of scan signal stages (GD).

The scan signal stages (GD) respectively generate a gate signal and output the same. The output gate signal is transmitted to the pixel PX included in the present-end pixel row through the scan line 121 and to the pixel PX included in the next pixel row through the previous-end scan line 123. Further, the scan signal stages (GD) respectively apply a gate signal to a next-end scan signal stage (GD) as a carry signal. One scan line 121 and one previous-end scan line 123 may receive the same gate signal from the first scan signal generator 410 and the second scan signal generator 420. A gate-on voltage and a gate-off voltage are alternately applied as the gate signal, and at least one gate-on voltage is included for one frame. In the present exemplary embodiment, the gate-on voltage and the gate-off voltage are alternately applied three times for one frame (refer to FIG. 4).

The scan signal generators 410 and 420 may further include a 0-th scan signal stage (GD[0]) to apply the gate signal to the previous-end scan line 123 connected to the pixel PX in the first pixel row.

The emitting signal generator 510 is in the non-display area on the right side of the display area 300, with the scan signal generator 410 there between. The second emitting signal generator 520 is in the non-display area on the left side of the display area 300, with the scan signal generator 420 there between.

The emitting signal generators 510 and 520 each include a plurality of emitting signal stages (EM). One emitting signal line 151 is connected to one corresponding emitting signal stage (EM), and receives an emitting signal from one emitting signal stage (EM). As a result, the emitting signal stage (EM) corresponding to the emitting signal line 151 controlled by the emitting signal stage (EM) provided in the first emitting signal generator 510 does have a corresponding stage in the second emitting signal generator 520. Further, two adjacent emitting signal stages (EM) are in the respective emitting signal generators 510 and 520.

According to the exemplary embodiment shown with reference to FIG. 1, the emitting signal output by one emitting signal stage (EM) is applied to pixels PX in two pixel rows. That is, the emitting signal stage shown as EM[1,2] in FIG. 1 applies the emitting signal to the first pixel row and the second pixel row. However, depending on exemplary embodiments, the emitting signal may be applied to one pixel row or to at least three pixel rows. In other words, one emitting signal stage (EM) may be connected to n-numbered emitting signal lines 151 and applies emitting signals to the pixels PX included in n-numbered pixel rows. Here, n is a natural number that is equal to or greater than 1.

The emitting signal is alternately applied as a low-level voltage (corresponding to an emission section) and a high-level voltage (corresponding to a programming section).

One frame includes one high-level voltage section (a programming section). Further, a time for the emitting signal to be constantly applied as a low-level voltage and a high-level voltage is very much longer than a time for applying one gate-on voltage. Because of the above-noted characteristic, the entire emitting signal may be applied to a plurality of emitting signal lines 151. However, the time for applying the gate-on voltage is very short, so a gate signal is applied to one scan line 121 and one previous-end scan line 123 for each scan signal stage (GD).

Figure 2:
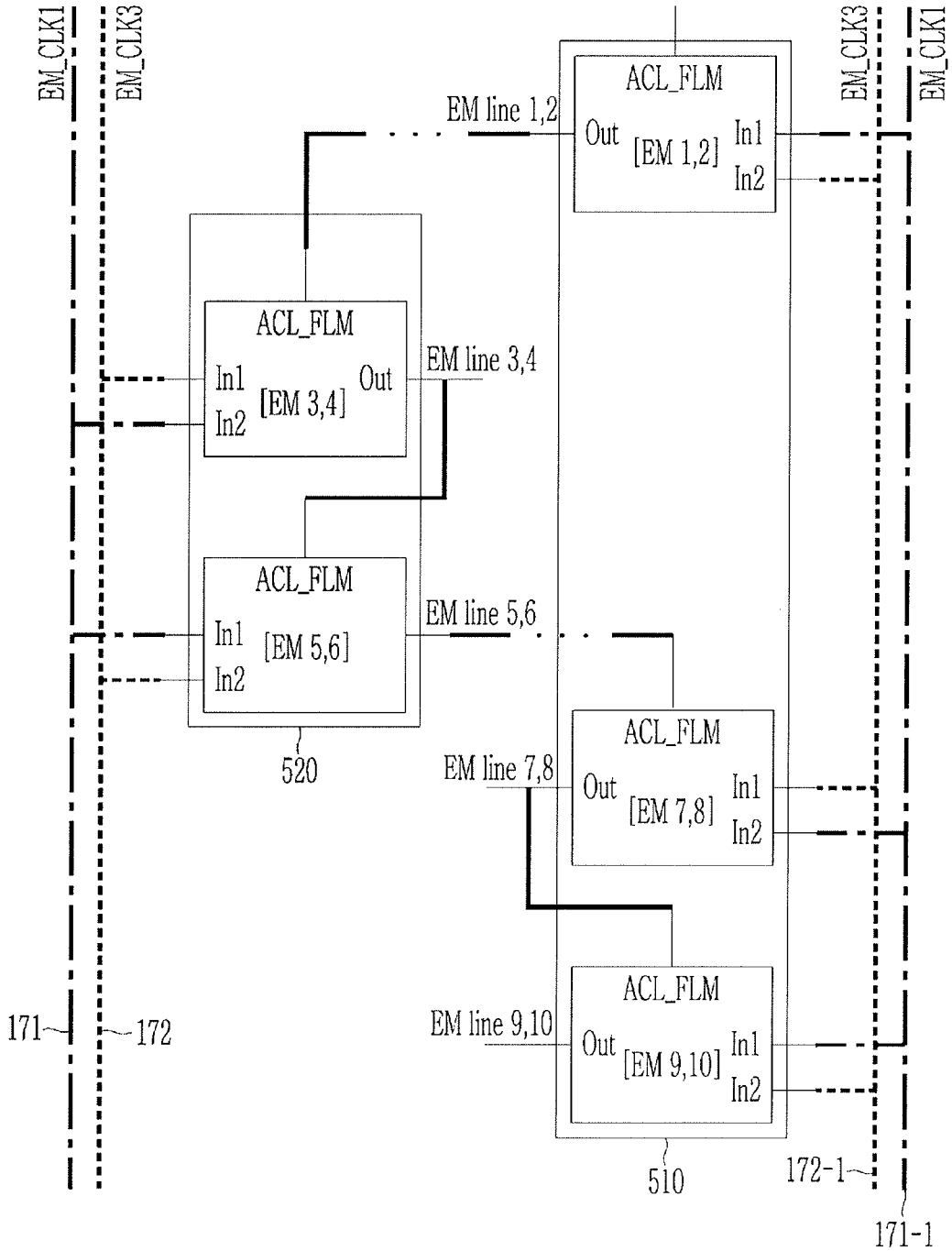
FIG. 2 illustrates an emitting signal generator according to an exemplary embodiment.

An emitting signal generator according to an exemplary embodiment will now be described in detail with reference to FIG. 2. FIG. 2 illustrates a plurality of emitting signal stages (EM) provided in the first emitting signal generator 510 and the second emitting signal generator 520. In an exemplary embodiment of FIG. 2, two emitting signal lines 151 are connected to each emitting signal stage (EM) as shown in FIG. 1.

The respective emitting signal stages (EM) of the emitting signal generators 510 and 520 include a first clock signal input end In1 and a second clock signal input end In2 for receiving two clock signals, a control end (ACL_FLM) for receiving a control signal (FLM) or an emitting signal from a previous-end emitting signal stage (EM), and an output end (Out) for outputting an emitting signal.

A connection relationship of the respective emitting signal stages (EM) will now be described. The emitting signal stage (EM[1,2]; also referred to as a first emitting signal stage) for applying emitting signals to first and second emitting signal lines (EM lines 1 and 2) is in the first emitting signal generator 510. An emitting signal is applied to the pixels PX connected to the first pixel row and the second pixel row through the first emitting signal stage (EM[1,2]). As a result, the pixels PX connected to the first pixel row and the second pixel row simultaneously emit light.

The first emitting signal stage (EM[1,2]) receives a control signal (FLM) at a control end (ACL_FLM) from the outside, a first clock signal (EM_CLK1) at a first clock signal input end In1, and a third clock signal (EM_CLK3) at a second clock signal input end In2. An emitting signal is output from the first emitting signal stage (EM[1,2]) to the first and second emitting signal lines (EM lines 1 and 2) through the output end (Out) of the first emitting signal stage (EM[1,2]).

The emitting signal output by the first emitting signal stage (EM[1,2]) is a carry signal that is transmitted to the second emitting signal generator 520 and is applied to the control end (ACL_FLM) of a next emitting signal stage (EM[3,4]). The emitting signal stage (EM[3,4]; also referred to as a second emitting signal stage) for applying emitting signals to third and fourth emitting signal lines (EM lines 3 and 4) in the second emitting signal generator 520. An emitting signal is applied to the pixel PX connected to the third pixel row and the fourth pixel row through the second emitting signal stage (EM[3,4]). As a result, the pixels PX connected to the third pixel row and the fourth pixel row emit light.

The second emitting signal stage (EM[3,4]) receives the carry signal at the control end (ACL_FLM) from the first emitting signal stage (EM[1,2]), the third clock signal (EM_CLK3) at the first clock signal input end In1, and the first clock signal (EM_CLK1) at the second clock signal input end In2. The emitting signal is applied to the third and fourth emitting signal lines (EM lines 3 and 4) through the output end (Out) of the second emitting signal stage (EM [3,4]).

The emitting signal output by the second emitting signal stage (EM[3,4]) is applied as a carry signal to the control end (ACL_FLM) of the third emitting signal stage (EM[5,6]) in the second emitting signal generator 520. The emitting signal stage (EM[5,6]; also referred to as a third emitting signal stage) for applying an emitting signal to the fifth and sixth emitting signal lines (EM lines 5 and 6) is a second emitting signal generator 520 provided on the left of the display area 300, and is provided below the second emitting signal stage (EM[3,4]). That is, two adjacent emitting signal stages are provided on the same emitting signal generator. The third emitting signal stage (EM[5,6]) applies an emitting signal to the pixel PX connected to the fifth pixel row and the sixth pixel row. As a result, the pixels PX connected to the fifth pixel row and the sixth pixel row emit light.

The third emitting signal stage (EM[5,6]) receives the emitting signal as a carry signal from the second emitting signal stage (EM[3,4]) through the control end (ACL_FLM), the first clock signal (EM_CLK1) at the first clock signal input end In1, and the third clock signal (EM_CLK3) at the second clock signal input end In2. The emitting signal is applied to the fifth and sixth emitting signal lines (EM lines 5 and 6) through the output end (Out).

The emitting signal output by the third emitting signal stage (EM[5,6]) is applied as a carry signal to the control end (ACL_FLM) of the fourth emitting signal stage (EM[7,8]) in the first emitting signal generator 510. The emitting signal stage (EM[7,8]; also referred to as a fourth emitting signal stage) for applying an emitting signal to the seventh and eighth emitting signal lines (EM lines 7 and 8) is in the first emitting signal generator 510 below the first emitting signal stage (EM[1,2]). An emitting signal is applied to the pixel PX connected to the seventh pixel row and the eighth pixel row through the fourth emitting signal stage (EM[7,8]). As a result, the pixels PX connected to the seventh pixel row and the eighth pixel row emit light.

The fourth emitting signal stage (EM[7,8]) receives the emitting signal form the third emitting signal stage (EM[5, 6]) at the control end (ACL_FLM), the third clock signal (EM_CLK3) at the first clock signal input end In1, and the first clock signal (EM_CLK1) at the second clock signal input end In2. The emitting signal is applied to the seventh and eighth emitting signals line (EM lines 7 and 8) through the output end (Out) of the fourth emitting signal stage (EM[7,8]).

The emitting signal output by the fourth emitting signal stage (EM[7,8]) is applied as a carry signal to the control end (ACL_FLM) of the fifth emitting signal stage (EM[9,10]) in the first emitting signal generator 510. The emitting signal stage (EM[9,10]; also referred to as a fifth emitting signal stage) for applying an emitting signal to the ninth and tenth emitting signal lines (EM lines 9 and 10) is a first emitting signal generator 510 below the fourth emitting signal stage (EM[7,8]). That is, two adjacent emitting signal stages are provided on the same emitting signal generator.

An emitting signal is applied to the pixel PX connected to the ninth pixel row and the tenth pixel row through the fifth emitting signal stage (EM[9,10]). As a result, the pixels PX connected to the ninth pixel row and the tenth pixel row emit light.

The fifth emitting signal stage (EM[9,10]) receives the emitting signal from the fourth emitting signal stage (EM [7,8]) as a carry signal at the control end (ACL_FLM), the first clock signal (EM_CLK1) at the first clock signal input end In1, and the third clock signal (EM_CLK3) at the second clock signal input end In2. The emitting signal is applied to the ninth and tenth emitting signal lines (EM lines 9 and 10) through the output end (Out) of the fifth emitting signal stage (EM[9,10]).

The emitting signal output by the fifth emitting signal stage (EM[9,10]) is applied as a carry signal to the control end (ACL_FLM) of the sixth emitting signal stage in the second emitting signal generator 520. In a like manner, the emitting signal stage is formed in the first and second emitting signal generators 510 and 520, and each emitting signal stage emits the pixels PX of two pixel rows.

Depending on exemplary embodiments, one emitting signal stage (EM) may control at least three pixel rows to emit light. In the present exemplary embodiment, two emitting signal stages (EM) are continuously provided in one of the emitting signal generators 510 and 520. However, depending on exemplary embodiments, even-numbered (e.g., 4 or 6) emitting signal stages (EM) may be continuously formed in one of the emitting signal generators 510 and 520.

When the even-numbered emitting signal stages (EM) are in the emitting signal generators 510 and 520 as described, two clock signal wires (171, 172, 171-1, and 172-1) for applying two clock signals (EM_CLK1 and EM_CLK3) are alternately connected to the first clock signal input end In1 and the second clock signal input end In2 of the emitting signal stage (EM).

That is, referring to FIG. 2, regarding the two clock signal wires 171 and 172 provided on the left of the display area 300, the first clock signal wire 171 is connected to the second clock signal input end In2, and the second clock signal wire 172 is connected to the first clock signal input end In1 on the second emitting signal stage (EM[3,4]). However, the first clock signal wire 171 is connected to the first clock signal input end In1, and the second clock signal wire 172 is connected to the second clock signal input end In2 on the third emitting signal stage (EM[5,6]) provided below the same. As a result, when the clock signal input ends In1 and In2 of the emitting signal stage (EM) have very different values of capacitance, there is no difference of loads between the clock signal wires 171 and 172 provided on the left of the display area 300.

As a result, when static electricity is input from the outside, it is not transmitted through a specific wire, so a specific input end of the emitting signal stage is not damaged by static electricity. Further, a specific clock signal is not delayed by the difference of loads between the clock signal wires 171 and 172 is provided.

Regarding the clock signal wires 171-1 and 172-1 provided on the right of the display area 300, the first clock signal wire 171-1 is connected to the second clock signal input end In2, and the second clock signal wire 172-1 is connected to the first clock signal input end In1 on the fourth emitting signal stage (EM[7,8]). However, the first clock signal wire 171-1 is connected to the first clock signal input end In1, and the second clock signal wire 172-1 is connected to the second clock signal input end In2 on the fifth emitting signal stage (EM[9,10]) provided below the same.

As a result, when the clock signal input ends In1 and In2 of the emitting signal stage (EM) have very different values of capacitance, there is no difference of loads between the clock signal wires 171-1 and 172-1 of the display area 300. As a result, when static electricity is input from the outside, it is not transmitted through a specific wire, so a specific input end of the emitting signal stage is not damaged by static electricity. Further, a specific clock signal is not delayed by the difference of loads between the clock signal wires 171-1 and 172-1.

Further, an emitting signal stage receiving a carry signal from another emitting signal stage will have the first and third clock signals applied to opposite clock signal input ends.

A configuration of an emitting signal stage (EM) according to the present exemplary embodiment will now be described with reference to FIG. 3. The emitting signal stage (EM) in FIG. 3 includes a first clock signal input end In1 with much capacitance, and a second clock signal input end In2 with relatively less capacitance.

Each emitting signal stage (EM) included in the emitting signal generators 510 and 520 according to the present exemplary embodiment includes a high-level output unit 551, a low-level output unit 552, a first-node first controller 553, a first-node second controller 554, a second-node first controller 555, a second-node second controller 556, and a third-node controller 557.

The high-level output unit 551 outputs a high voltage (VGH) of an emitting signal, and the low-level output unit 552 outputs a low voltage (VGL) of an emitting signal. The high-level output unit 551 and the low-level output unit 552 are connected to the output end (Out), and when the high-level output unit 551 outputs the high voltage (VGH), the low-level output unit 552 does not output, and when the low-level output unit 552 outputs the low voltage (VGL), the high-level output unit 551 does not output.

The high-level output unit 551 is controlled by a voltage at the first node N1 controlled by the first-node first controller 553 and the first-node second controller 554. The low-level output unit 552 is controlled by a voltage at the second node N2 controlled by the second-node first controller 555 and the second-node second controller 556. In FIG. 3, the second-node first controller 555 is divided into a first second-node first controller 555-1 and a second second-node first controller 555-2. The first-node second controller 554 is controlled by a voltage at the third node N3 controlled by the third node controller 557.

Figure 3:
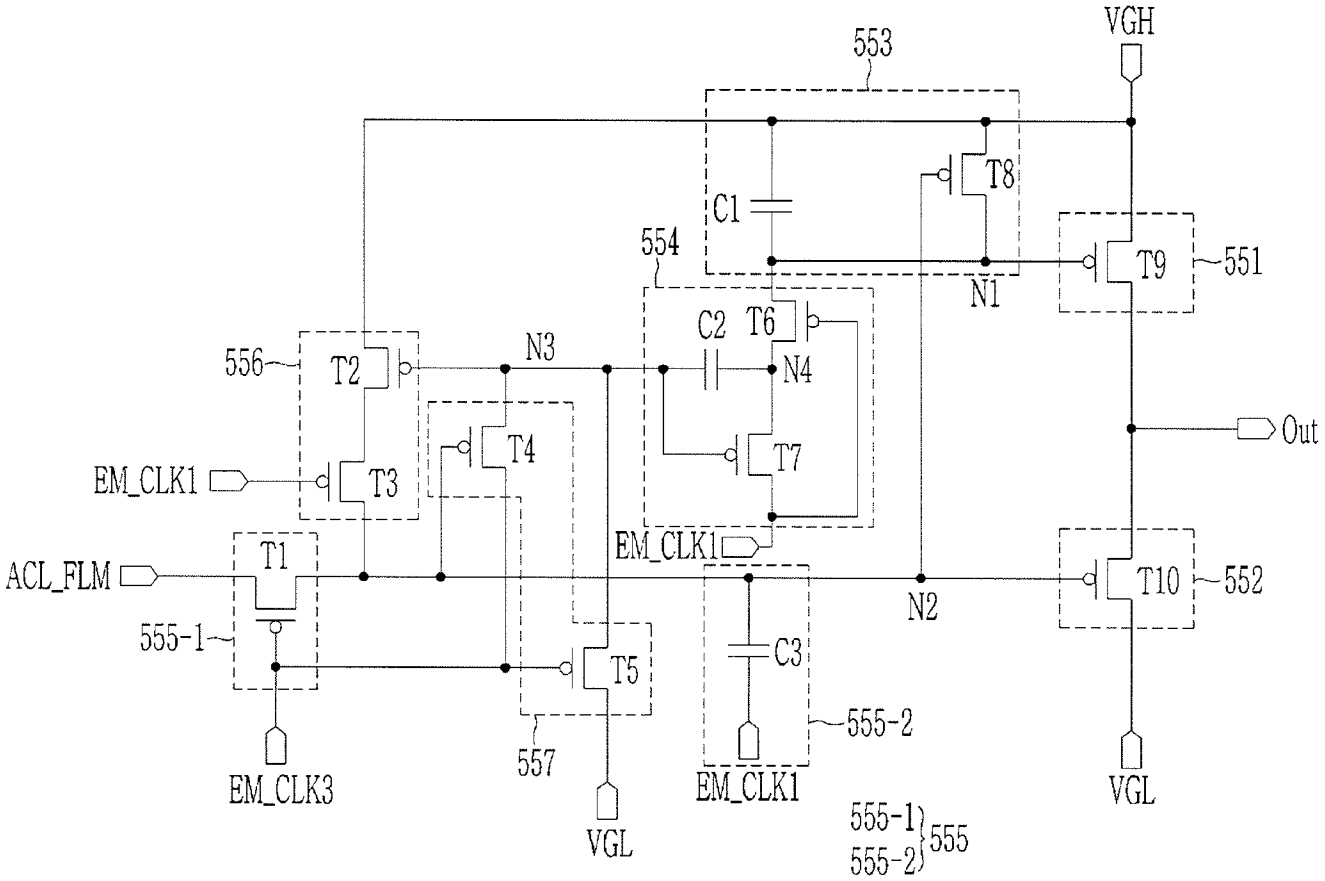
FIG. 3 illustrates a circuit diagram of a stage of an emitting signal generator according to an exemplary embodiment.

Regarding the emitting signal stage (EM) shown in FIG. 3, in a like manner of the odd-numbered emitting signal stage (EM) of FIG. 2, the first clock signal wire 171 for clock signals is connected to the first clock signal input end In1 to apply the first clock signal (EM_CLK1), and the second clock signal wire 172 for clock signals is connected to the second clock signal input end In2 to apply the third clock signal (EM_CLK3). Further, however, clock signals that are opposite to the above-noted ones may be applied to the even-numbered emitting signal stage (EM).

Respective parts will now be described in detail.

The high-level output unit 551 includes a ninth transistor T9 having a control electrode connected to a first node N1, an input electrode connected to a high voltage (VGH) terminal, and an output electrode connected to the output end (Out). As a result, when the voltage at the first node N1 is a low voltage, the high voltage (VGH) is output to the output end (Out), and when the voltage at the first node N1 is a high voltage, the ninth transistor T9 provides no output.

The low-level output unit 552 includes a tenth transistor T10 having a control electrode connected to a second node N2, an input electrode connected to a low voltage (VGL) terminal, and an output electrode connected to the output end (Out). As a result, when the voltage at the second node N2 is a low voltage, the low voltage (VGL) is output to the output end (Out), and when the voltage at the second node N2 is a high voltage, the tenth transistor T10 provides no output.

The voltage at the first node N1 is controlled by the first-node first controller 553 and the first-node second controller 554.

The first-node first controller 553 includes a transistor (eighth transistor T8) and a capacitor (first capacitor C1). The eighth transistor T8 includes a control electrode connected to the second node N2, an input electrode connected to the high voltage (VGH), and an output electrode connected to the first node N1. Two electrodes of the first capacitor C1 are connected to an input electrode and an output electrode of the eighth transistor, so the first capacitor C1 is connected between the first node N1 and the high voltage (VGH) terminal. The eighth transistor T8 transmits the high voltage (VGH) to the first node N1 when the second node N2 is a low voltage, and the first capacitor C1 stores and maintains the voltage at the first node N1. That is, the first-node first controller 553 changes the voltage at the first node N1 to the high voltage (VGH).

The first-node second controller 554 includes two transistors (a sixth transistor T6 and a seventh transistor T7) and a capacitor (a second capacitor C2). The sixth transistor T6 includes a control electrode connected to the first clock signal input end In1, an output electrode connected to the first node N1, and an input electrode connected to a fourth node N4. The seventh transistor T7 includes a control electrode connected to a third node N3, an output electrode connected to a fourth node N4, and an input electrode connected to the first clock signal input end In1. Here, input and output operations of the input electrode and the output electrode may be exchanged to each other depending on a size of the connected voltage. The first-node second controller 554 changes the voltage at the first node N1 to the low voltage of the clock signal.

The second capacitor C2 is connected between the third node N3 and the fourth node N4, and the voltage at the fourth node N4 may be boosted up by using a voltage difference between the two nodes.

The voltage at the second node N2 is controlled by the second-node first controller 555 and the second-node second controller 556.

The second-node first controller 555 includes the first second-node first controller 555-1 and the second second-node first controller 555-2. The first second-node first controller 555-1 includes a transistor (a first transistor T1) and the second second-node first controller 555-2 includes a capacitor (a third capacitor C3). The first transistor T1 includes a control electrode connected to the second clock signal input end IN2, an input electrode connected to the control end (ACL_FLM), and an output electrode connected to the second node N2. The third capacitor C3 includes a first side electrode connected to the second node N2 and a second side electrode connected to the first clock signal input end IN1.

According to the configuration of the third capacitor C3, the voltage at the second node N2 may be changed by the variable clock signal applied to the first clock signal input end IN1. To reduce the variation of the second node N2, capacitance of the third capacitor C3 may be set to be substantially large. As a result, when the clock signal applied to a second side of the third capacitor C3 is changed, the voltage at the first side, that is, the voltage at the second node N2, may not be substantially changed. By the third capacitor C3, capacitance of the first clock signal input end IN1 has a substantially large value compared to capacitance of the second clock signal input end IN2.

The first transistor T1 belonging to the second-node first controller 555 changes the voltage at the second node N2 to a voltage of the control signal (FLM) or the emitting signal at the previous-end when the third clock signal (EM_CLK3) applied to the second clock signal input end IN2 is a low voltage, and the third capacitor C3 then stores and maintains the same. That is, the second-node first controller 555 changes the voltage at the second node N2 to a high voltage or a low voltage according to a carry signal (a control signal (FLM) or an emitting signal of the previous-end).

The second-node second controller 556 includes two transistors (a second transistor T2 and a third transistor T3). The second transistor T2 includes a control electrode connected to the third node N3, an input electrode connected to the high voltage (VGH) terminal, and an output electrode connected to the input electrode of the third transistor T3. The third transistor T3 includes a control electrode connected to the first clock signal input end IN1, an input electrode connected to the output electrode of the second transistor T2, and an output electrode connected to the second node N2. That is, regarding the second-node second controller 556, the high voltage (VGH) is connected to the second node N2 so that the voltage at the second node N2 may not be changed to the low voltage.

The third node controller 557 includes two transistors (a fourth transistor T4 and a fifth transistor T5). The fourth transistor T4 includes a control terminal connected to the second node N2, an input terminal connected to the second clock signal input end IN2, and an output terminal connected to the third node N3. The fifth transistor T5 includes a control terminal connected to the second clock signal input end IN2, an input terminal connected to the low voltage (VGL) terminal, and an output terminal connected to the third node N3. The fifth transistor T5 changes the voltage at the third node N3 to the low voltage (VGL), and the fourth transistor T4 changes the voltage at the third node N3 to the voltage of the second clock signal input end IN2 to also change the voltage at the third node N3 to the high voltage (a high voltage of the clock signal).

Figure 4:
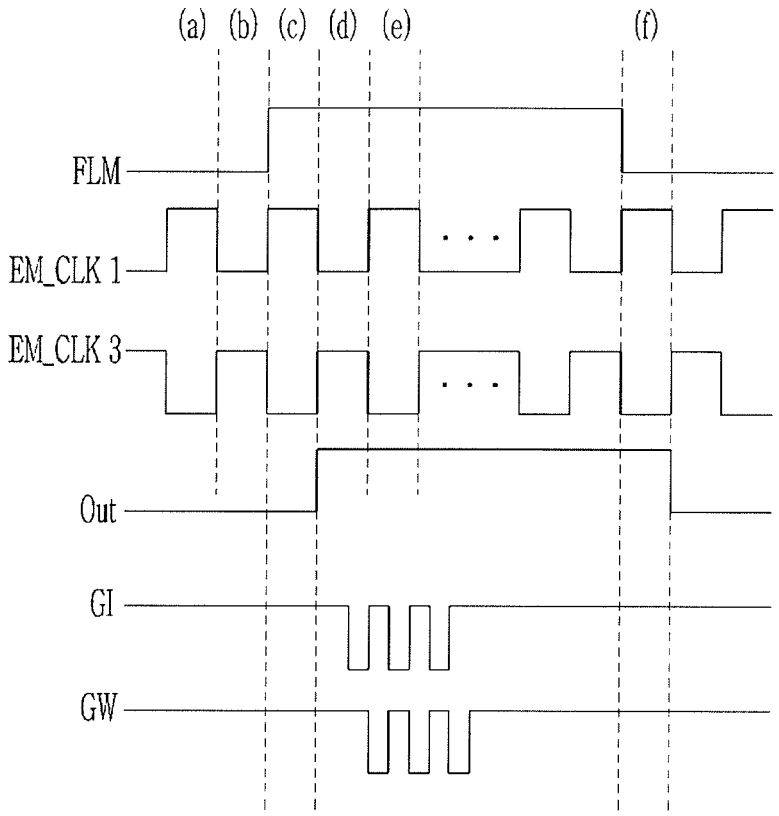
FIG. 4 illustrates a waveform diagram of a signal applied to a stage according to an exemplary embodiment.

The above-configured emitting signal stage (EM) is operated by the signals applied to the first clock signal input end In1, the second clock signal input end In2, and the control end (ACL_FLM), which will be now described with reference to FIG. 4 to FIG. 10. FIG. 4 shows a waveform diagram of a signal applied to a stage according to an exemplary embodiment. FIG. 5 to FIG. 10 show an operation of a stage shown in FIG. 3.

First, signals applied to the first clock signal input end In1, the second clock signal input end In2, and the control end (ACL_FLM) of the emitting signal stage (EM) will be described with reference to FIG. 4. In the present exemplary embodiment, a first clock signal (EM_CLK1) is applied to the first clock signal input end In1, and a third clock signal (EM_CLK3) is applied to the second clock signal input end In2. The first clock signal (EM_CLK1) and the third clock signal (EM_CLK3) are clock signals with alternately applied high voltage and low voltage, and are inverted with respect to each other.

A control signal (FLM) applied from the outside is transmitted as a carry signal to the control end (ACL_FLM) of the first emitting signal stage (EM[1,2]), and an output signal of the previous-end emitting signal stage, i.e., an emitting signal, is transmitted as a carry signal from the second emitting signal stage (EM[3,4]). The control signal (FLM) and the emitting signal include one high voltage section for one frame, and a low voltage is applied for a remaining section. A high voltage section is a section (a programming section) in which a data voltage is programmed to the pixel PX, and the pixel PX emits light (an emitting section) for a low voltage section.

For reference, FIG. 4 shows a scan signal (GI) and a previous-end scan signal (GW). A characteristic of the scan signal according to the present exemplary embodiment is that three low voltages are applied for one frame. However, according to an exemplary embodiment, the low voltage may be applied once or the low voltage may be applied for a different number of times. A present-end scan signal (GI) and a previous-end scan signal (GW) applied to one pixel PX are provided in the high voltage section (the programming section) of the emitting signal applied to the corresponding pixel PX.

In FIG. 4, the voltage applied to the emitting signal stage is divided by sections, e.g., time periods, including (a), (b), (c), (d), (e), and (f). An operation of an emitting signal stage for respective sections will now be described with reference to FIG. 5 to FIG. 10. In FIG. 5 to FIG. 10, when a turned off transistor is marked with an X, and when the transistor performs a major operation while turned on, a straight line for connecting an input electrode and an output electrode of the transistor is used illustrate that the same is turned on. In addition, the voltages at the first to fourth nodes (N1, N2, N3, and N4) are shown in parentheses for easy viewing. H in parentheses signifies a high voltage, and L in parentheses means a low voltage.

Figure 5:
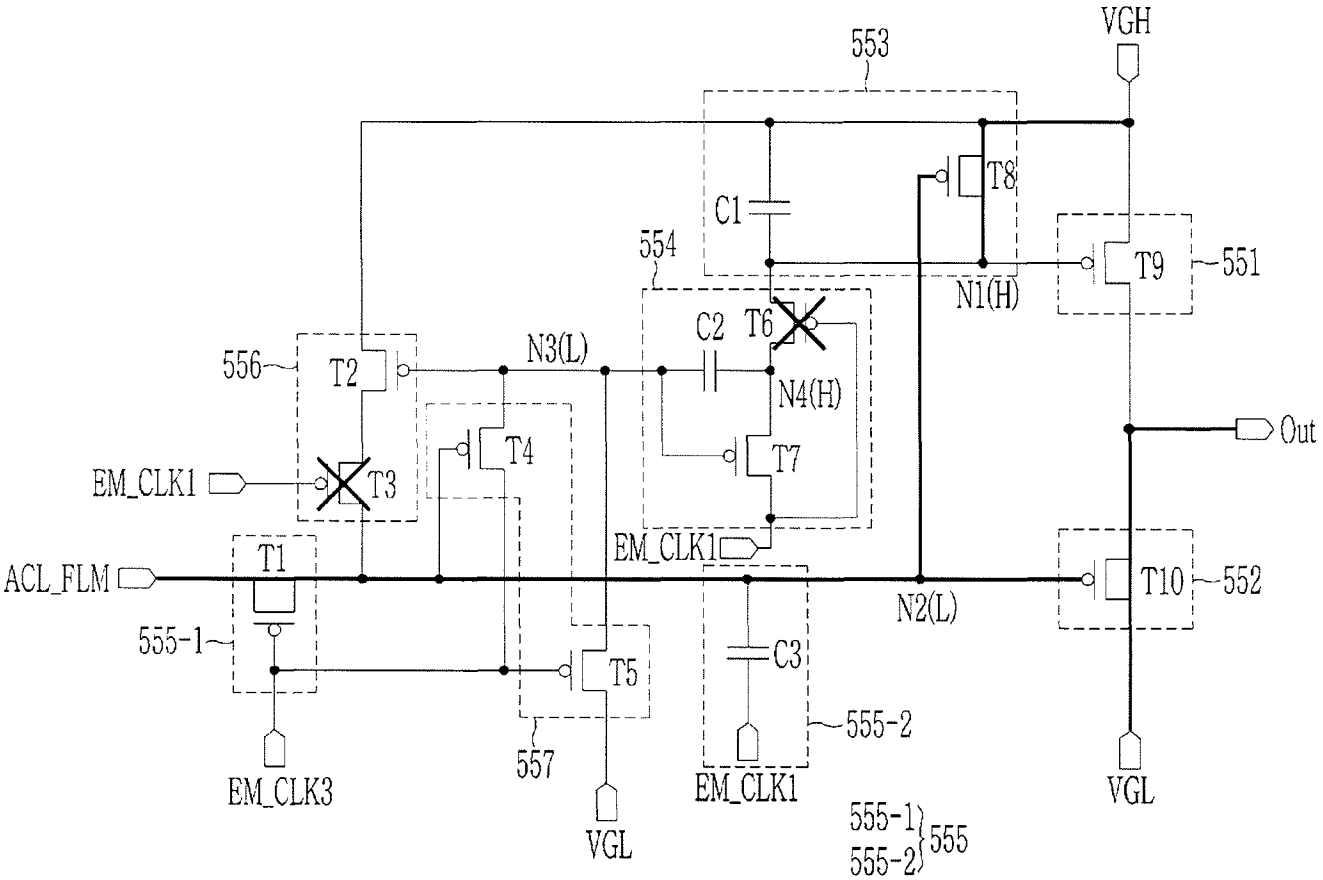
FIG. 5 to FIG. 10 illustrates an operation of a stage shown in FIG. 3.

An operation of an emitting signal stage (EM) in section (a) will now be described with reference to FIG. 5. In section (a), the control signal (FLM) is applied as a low voltage, a high-voltage first clock signal (EM_CLK1) is applied to the first clock signal input end In1, and a low-voltage third clock signal (EM_CLK3) is applied to the second clock signal input end In2.

The third transistor T3 and the sixth transistor T6 are turned off by the high-voltage first clock signal (EM_CLK1), and the first transistor T1 and the fifth transistor T5 are turned on by the low-voltage third clock signal (EM_CLK3). The low-voltage control signal (FLM) is applied to the second node N2 through the first transistor T1, so the low voltage at the second node N2 is stored in the third capacitor C3. The tenth transistor T10 is turned on by the low voltage at the second node N2, and the low voltage (VGL) is output to the output end (Out). The eighth transistor T8 is turned on by the low voltage at the second node N2, so the first node N1 becomes a high voltage (VGH), and respective ends of the first capacitor C1 become a high voltage (VGH). As a result, the ninth transistor T9 is turned off.

The fourth transistor T4 is turned on by the low voltage at the second node N2, so a low voltage value of the third clock signal (EM_CLK3) is applied, and the voltage at the third node N3 is applied as a low voltage. Further, the low voltage (VGL) is applied through the fifth transistor T5.

The seventh transistor T7 is turned on by the low voltage (VGL) at the third node N3, so the first clock signal (EM_CLK1) with a high voltage is applied to the fourth node N4. As a result, the high voltage (fourth node N4) and the low voltage (third node N3) are applied to the respective ends of the second capacitor C2.

Further, the second transistor T2 is turned on by the low voltage (VGL) at the third node N3, but the third transistor T3 is turned off, so the high voltage (VGH) is not transmitted to the second node N2, and the high voltage (VGH) is transmitted to the input electrode of the third transistor T3.

That is, in section (a), a high voltage (H) is applied to the first node N1, a low voltage (L) is applied to the second node N2, a low voltage (L) is applied to the third node N3, a high voltage (H) is applied to the fourth node N4, and regarding a major operation, the tenth transistor T10 is turned on by the low voltage (L) at the second node N2, and a low voltage (VGL) is applied to the output end (Out). In this instance, the pixel PX receiving an emitting signal is in the emission section.

Figure 6:
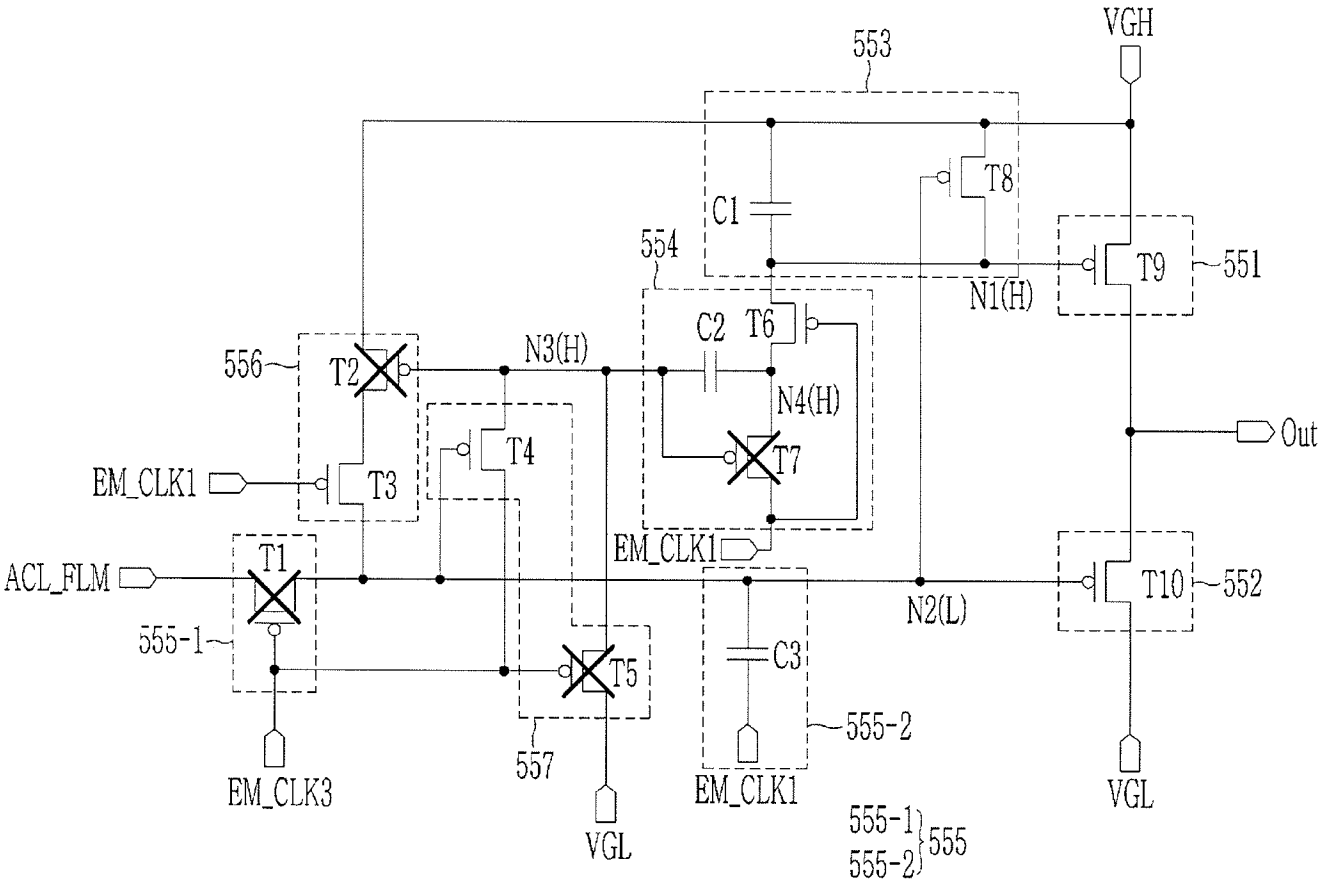

An operation of an emitting signal stage in section (b) will now be described with reference to FIG. 6. In section (b), the control signal (FLM) is maintained at the low voltage, the low-voltage first clock signal (EM_CLK1) is applied to the first clock signal input end In1, and the high-voltage third clock signal (EM_CLK3) is applied to the second clock signal input end In2.

The third transistor T3 and the sixth transistor T6 are turned on by the low-voltage first clock signal (EM_CLK1), and the first transistor T1 and the fifth transistor T5 are turned off by the high-voltage third clock signal (EM_CLK3). Since the first transistor T1 is turned off, the low voltage stored in the third capacitor C3 is maintained, so the voltage at the second node N2 has a low voltage value. As a result, the tenth transistor T10 is turned on, so the low voltage (VGL) is output to the output end (Out).

The eighth transistor T8 is turned on by the low voltage at the second node N2 so the first node N1 becomes a high voltage (VGH), the ninth transistor T9 maintains the turned off state, and the respective ends of the first capacitor C1 become a high voltage (VGH).

The fourth transistor T4 is turned on by the low voltage at the second node N2, so the third clock signal (EM_CLK3) with a high voltage is applied to the third node N3 and the voltage at the third node N3 is changed to a high voltage value. In this instance, the fifth transistor T5 is turned off, so the voltage is changed to the high voltage by the input of the fourth transistor T4 without changing the voltage at the third node N3.

The seventh transistor T7 is turned off by the high voltage at the third node N3, and the sixth transistor T6 is turned on by the low-voltage first clock signal (EM_CLK1), so the first node N1 is connected to the fourth node N4. In this instance, the voltage at the third node N3 connected to the second capacitor C2 is changed to the high voltage from the low voltage, so the voltage at the fourth node N4 and the voltage at the first node N1 connected thereto are boosted up. As a result, the voltage at the first node N1 has a higher voltage value than the high voltage (VGH). In another way, the second transistor T2 maintains the turned-off state by the high voltage of the third node N3, and the third transistor T3 is turned on by the low-voltage first clock signal (EM_CLK1). Here, the high voltage (VGH) transmitted to the input electrode of the third transistor T3 through the second transistor T2 in section (a) may be transmitted to the second node N2 when the third transistor T3 is turned on in section (b). This prevents the voltage at the second node N2 from being substantially reduced. That is, the first clock signal (EM_CLK1) is applied to a first side of the third capacitor C3, and the high voltage is changed to the low voltage in the section (b), so the voltage at the second node N2 may reduce. However, the voltage at the second node N2 may be maintained by the high voltage (VGH) applied through the second-node second controller 556. In addition, the voltage at the second node N2 may be maintained by increasing the capacitance of the third capacitor C3 regardless of a swing of a voltage level of the first clock signal (EM_CLK1).

That is, in section (b), a boosted-up high voltage (H) is applied to the first node N1 and the fourth node N4, a low voltage (L) is applied to the second node N2, and a high voltage (H) is applied to the third node N3. Regarding a major operation, the tenth transistor T10 is turned on by the low voltage of the second node N2, and the low voltage (VGL) is continuously applied to the output end (Out). At this time, the pixel PX receiving an emitting signal is provided in the emission section.

Comparing section (a) and section (b), a clock signal is inverted and is then applied, the voltage at the first node N1 is maintained at the high voltage, the voltage at the second node N2 is maintained at the low voltage, and the low voltage (VGL) is continuously output to the output end (Out).

Figure 7:
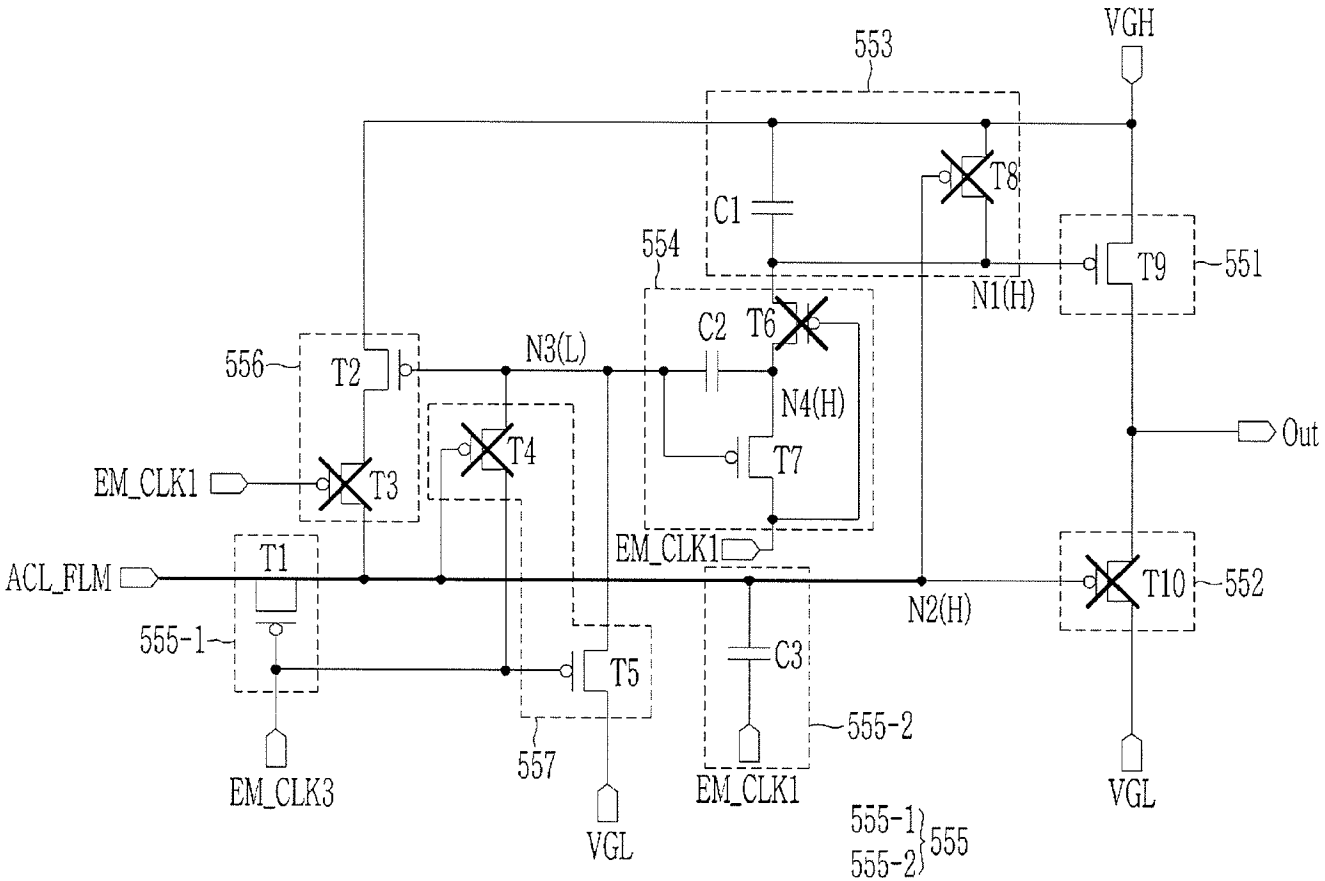

An operation of an emitting signal stage in section (c) will now be described with reference to FIG. 7. In section (c), the control signal (FLM) is changed to the high voltage, the first clock signal (EM_CLK1) is changed to the high voltage and applied to the first clock signal input end In1, and the third clock signal (EM_CLK3) is changed to the low voltage and applied to the second clock signal input end In2.

The third transistor T3 and the sixth transistor T6 are turned off by the high-voltage first clock signal (EM_CLK1). The first transistor T1 and the fifth transistor T5 are turned on by the low-voltage third clock signal (EM_CLK3). The high-voltage control signal is applied to the second node N2 through the first transistor T1, so the voltage at the second node N2 is changed to the high voltage and is then stored in the third capacitor C3. The tenth transistor T10 is turned off by the high voltage of the second node N2. The eighth transistor T8 is turned off by the high voltage of the second node N2.

The fifth transistor T5 is turned on, so the low voltage (VGL) is applied to the third node N3. Here, the second node N2 has a high voltage, so the fourth transistor T4 is turned off. As a result, the voltage at the third node N3 is controlled by the fifth transistor T5 and is changed to the low voltage (VGL).

The second transistor T2 and the seventh transistor T7 are turned on by the low voltage of the third node N3. The seventh transistor T7 is turned on, so the high-voltage first clock signal (EM_CLK1) is applied to the fourth node N4. As a result, the high voltage (fourth node N4) and the low voltage (third node N3) are applied to respective ends of the second capacitor C2. Further, the second transistor T2 is turned on, but the third transistor T3 is turned off, so the high voltage (VGH) is transmitted to the input electrode of the third transistor T3, and the high voltage (VGH) is not transmitted to the second node N2.

The sixth transistor T6 and the eighth transistor T8 are turned off, so the voltage of section (b) is maintained and the voltage at the first node N1 is maintained at the high voltage.

That is, in section (c), a high voltage (H) is applied to the first node N1, a high voltage (H) is applied to the second node N2, a low voltage (L) is applied to the third node N3, a high voltage (H) is applied to the fourth node N4, and the tenth transistor T10 and the ninth transistor T9 are turned off, so no voltage may be output to the output end (Out). Specifically, until the voltage at the second node N2 becomes a turn-off voltage of the tenth transistor T10, a low voltage (VGL) is output, and when the tenth transistor T10 is turned off, the output voltage gradually increases.

Figure 8:
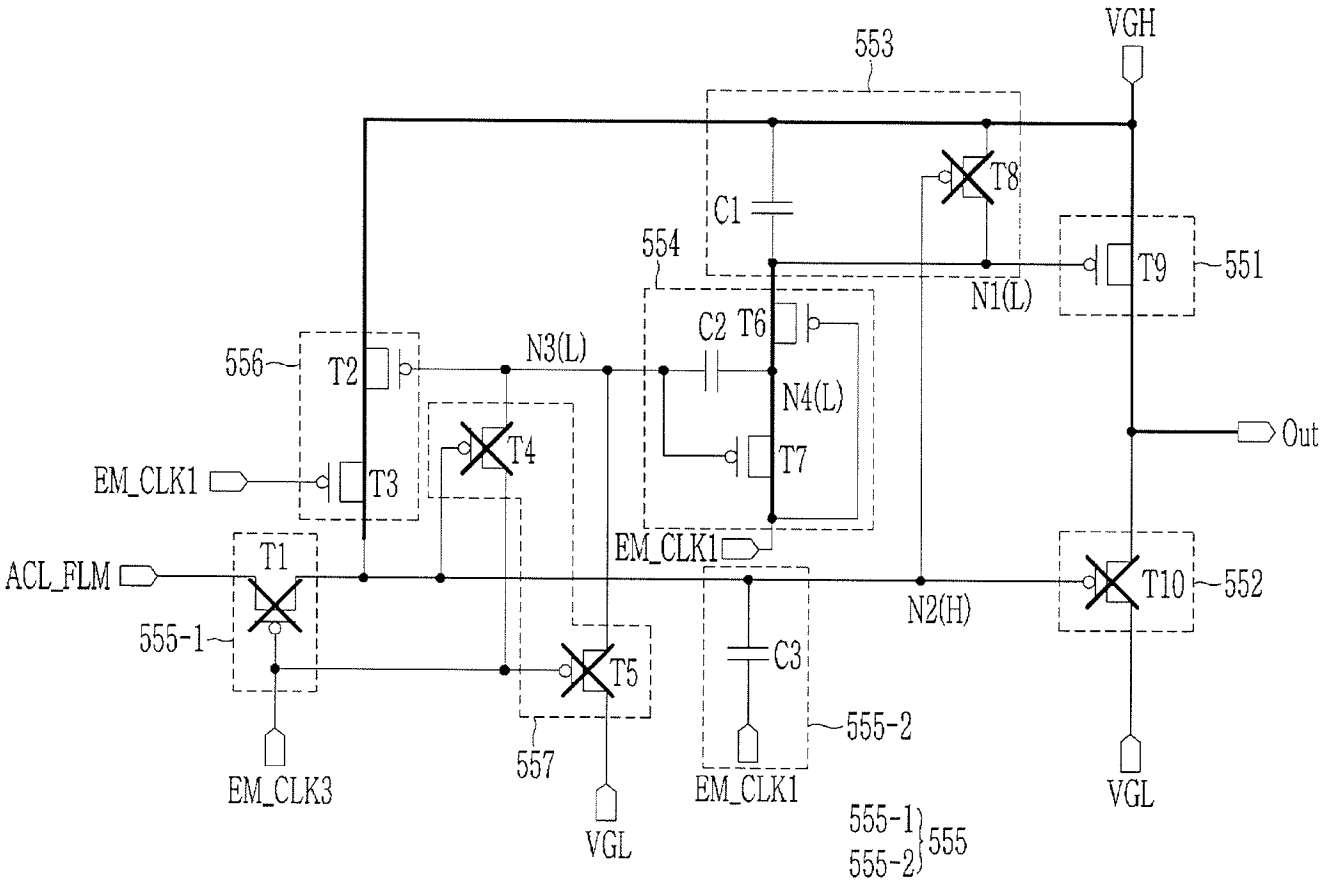

An operation of an emitting signal stage in section (d) will now be described with reference to FIG. 8. In section (d), the control signal (FLM) is maintained at the high voltage, the first clock signal (EM_CLK1) is changed to the low voltage and applied to the first clock signal input end In1, and the third clock signal (EM_CLK3) is changed to the high voltage and applied to the second clock signal input end In2.

The third transistor T3 and the sixth transistor T6 are turned on by the low-voltage first clock signal (EM_CLK1), and the first transistor T1 and the fifth transistor T5 are turned off by the high-voltage third clock signal (EM_CLK3).

The first transistor T1 is turned off, so the high voltage stored in the third capacitor C3 is maintained and the voltage at the second node N2 has a high voltage value. As a result, the tenth transistor T10 maintains the turned-off state. Further, the eighth transistor T8 and the fourth transistor T4 maintain the turned-off state by the high voltage of the second node N2.

The fifth transistor T5 is turned off by the high-voltage third clock signal (EM_CLK3). The fourth transistor T4 and the fifth transistor T5 are turned off, so the voltage at the third node N3 is not changed, and the low voltage that is the voltage at the third node N3 is maintained in section (c).

The seventh transistor T7 maintains the turned-on state by the low voltage of the third node N3, the sixth transistor T6 is turned on by the low-voltage first clock signal (EM_CLK1), so the first node N1, the fourth node N4, and the low-voltage first clock signal (EM_CLK1) are connected to each other. As a result, the voltages of the first node N1 and the fourth node N4 are changed to the low voltage. The ninth transistor T9 is turned on by the low voltage of the first node N1, so the high voltage (VGH) is output to the output end (Out).

The second transistor T2 is turned on by the low voltage of the third node N3, and the third transistor T3 is turned on by the low-voltage first clock signal (EM_CLK1), so the high-voltage (VGH) terminal is connected to the second node N2. As a result, the voltage of the second node N2 is maintained at the high voltage (VGH), and the tenth transistor T10 is not turned on.

That is, in section (d), a low voltage (L) is applied to the first node N1 and the fourth node N4, a high voltage (H) is applied to the second node N2, and a low voltage (L) is applied to the third node N3. Regarding a major operation, the ninth transistor T9 is turned on by the low voltage of the first node N1, and the high voltage (VGH) is output to the output end (Out). In this instance, the pixel PX receiving an emitting signal is provided in the programming section in which the data voltage is stored in the capacitor in the pixel PX.

Figure 9:
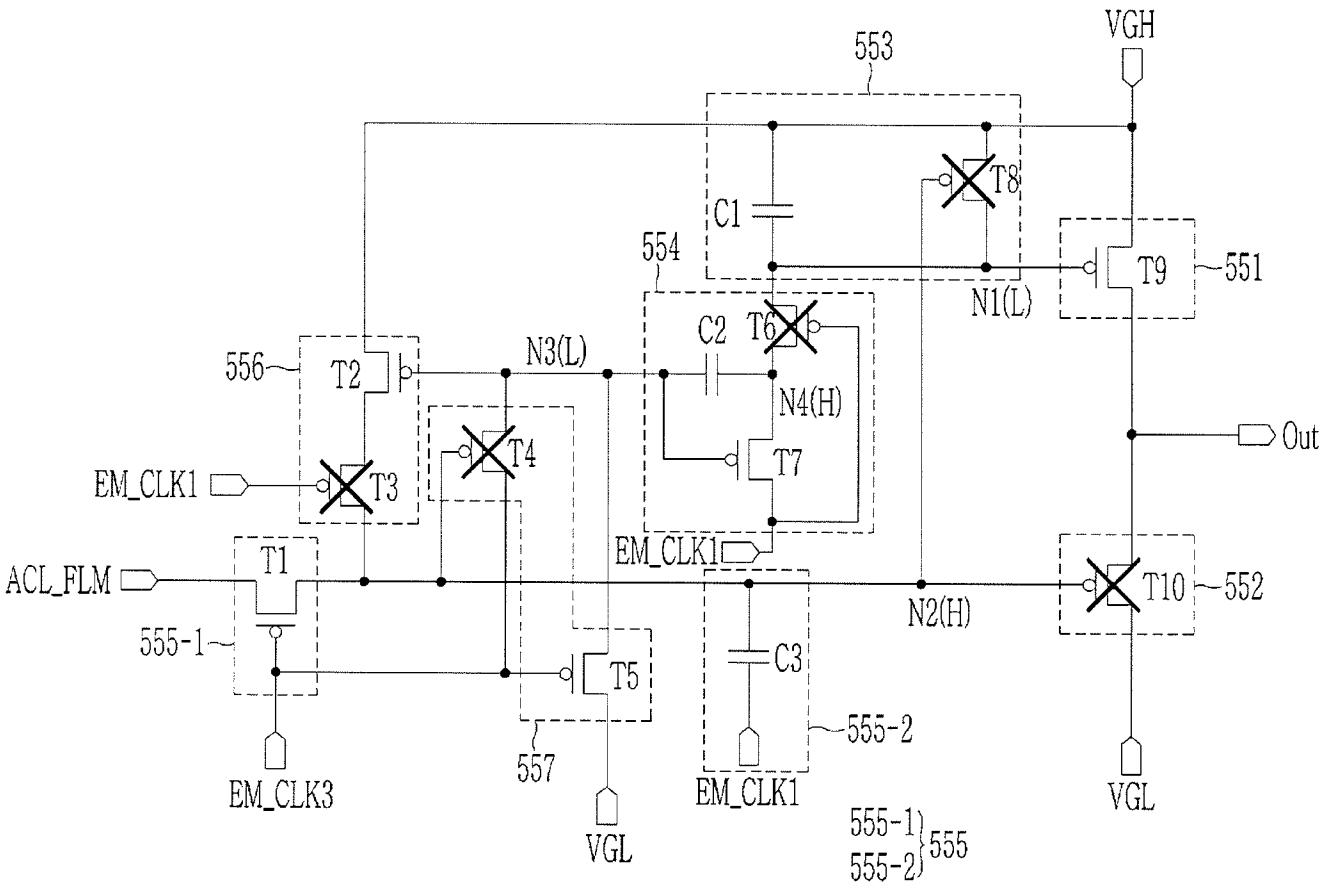

An operation of an emitting signal stage in section (e) will now be described with reference to FIG. 9. In section (e), the control signal (FLM) is maintained at the high voltage, the first clock signal (EM_CLK1) is changed to a high voltage and applied to the first clock signal input end In1, and the third clock signal (EM_CLK3) is changed to the low voltage and applied to the second clock signal input end In2.

The third transistor T3 and the sixth transistor T6 are turned off by the high-voltage first clock signal (EM_CLK1). The first transistor T1 and the fifth transistor T5 are turned on by the low-voltage third clock signal (EM_CLK3).

A high-voltage control signal is applied to the second node N2 through the first transistor T1 and the voltage at the second node N2 is maintained at the high voltage. The tenth transistor T10 is turned off by the high voltage of the second node N2. The eighth transistor T8 and the fourth transistor T4 are turned off by the high voltage of the second node N2.

The fifth transistor T5 is turned on, so the low voltage (VGL) is applied to the third node N3. In this instance, the fourth transistor T4 is turned off, so the fourth transistor T4 may not change the voltage at the third node N3.

The third node N3 has the low voltage (VGL), so the second transistor T2 and the seventh transistor T7 are turned on. As the seventh transistor T7 is turned on, the high-voltage first clock signal (EM_CLK1) is applied to the fourth node N4. As a result, the high voltage (fourth node N4) and the low voltage (third node N3) are applied to respective ends of the second capacitor C2.

Further, the second transistor T2 is turned on, and the third transistor T3 is turned off, so the high voltage (VGH) is transmitted to the input electrode of the third transistor T3, and the high voltage (VGH) is not transmitted to the second node N2.

The sixth transistor T6 is turned off by the high-voltage first clock signal (EM_CLK1), so the voltage stored in the first capacitor C1 is not changed, and the voltage at the first node N1 is maintained at the low voltage. As a result, the ninth transistor T9 is turned on, so the high voltage (VGH) is continuously output to the output end (Out).

That is, in section (e), a low voltage (L) is applied to the first node N1, a high voltage (H) is applied to the second node N2, a low voltage (L) is applied to the third node N3, and a high voltage (H) is applied to the fourth node N4, and the ninth transistor T9 maintains the turned-on state, so the high voltage (VGH) is output to the output end (Out).

Comparing section (d) and section (e), the clock signal is inverted and is then applied, but the voltage at the first node N1 is maintained at the low voltage, so the high voltage (VGH) is continuously output to the output end (Out). Further, the voltage at the second node N2 is maintained at the high voltage, so the low voltage (VGL) is not transmitted to the output end (Out).

Figure 10:
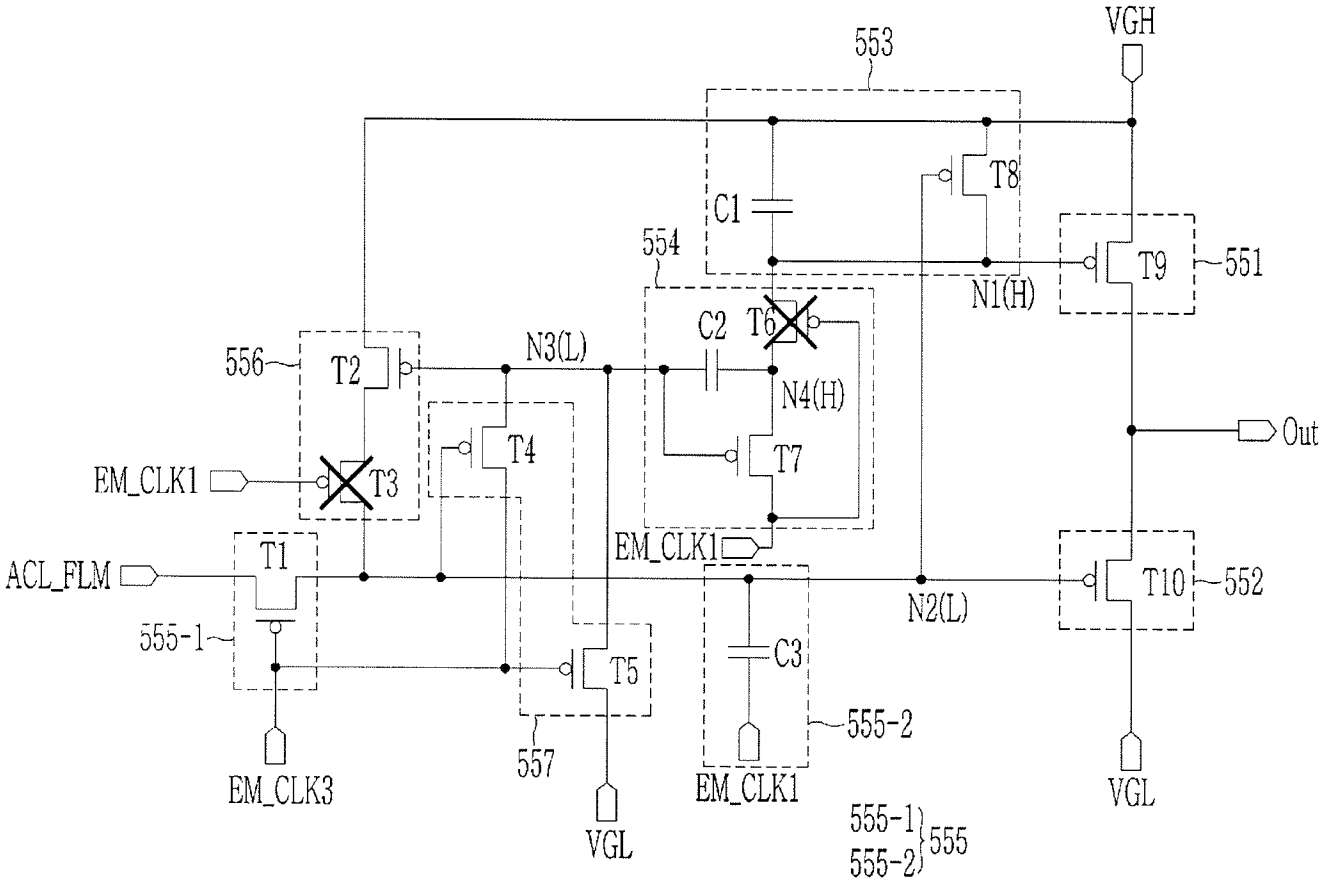

An operation of an emitting signal stage in section (f) will now be described with reference to FIG. 10. In the section (f), the control signal (FLM) is changed to a low voltage, the first clock signal (EM_CLK1) is changed to the high voltage and applied to the first clock signal input end In1, and the third clock signal (EM_CLK3) is changed to the low voltage and applied to the second clock signal input end In2. Further, section (f) is after a section that has the same state as section (d).

The third transistor T3 and the sixth transistor T6 are turned off by the high-voltage first clock signal (EM_CLK1), and the first transistor T1 and the fifth transistor T5 are turned on by the low-voltage third clock signal (EM_CLK3).

A low-voltage control signal is applied to the second node N2 through the first transistor T1, so the voltage at the second node N2 is changed to the low voltage, and the tenth transistor 10 is turned on. As a result, the low voltage (VGL) starts to be output to the output end (Out). The eighth transistor T8 and the fourth transistor T4 are turned on by the low voltage at the second node N2.

As the eighth transistor T8 is turned on, the high voltage (VGH) is applied to the first node N1, and the ninth transistor T9 is turned off by the high voltage of the first node N1, so the high voltage (VGH) is not output to the output end (Out) any longer.

As the fourth transistor T4 is turned on, the low-voltage third clock signal (EM_CLK3) is applied to the third node N3. Further, the low voltage (VGL) is applied to the third node N3 through the turned-on fifth transistor T5. As a result, the third node N3 has the low voltage.

The second transistor T2 and the seventh transistor T7 are turned on by the low voltage of the third node N3. As the seventh transistor T7 is turned on, the high-voltage first clock signal (EM_CLK1) is applied to the fourth node N4. As a result, the high voltage (fourth node N4) and the low voltage (third node N3) are applied to the respective ends of the second capacitor C2.

Further, the second transistor T2 is turned on, but the third transistor T3 is turned off, so the high voltage (VGH) is transmitted to the input electrode of the third transistor T3, and the high voltage (VGH) is not transmitted to the second node N2.

The sixth transistor T6 is turned off by the high-voltage first clock signal (EM_CLK1), so the voltage at the first node N1 is not influenced. As a result, the voltage at the first node N1 is controlled by the eighth transistor T8, and the high voltage (VGH) is transmitted through the eighth transistor T8 and the high voltage is maintained.

That is, in section (f), a high voltage (H) is applied to the first node N1, a low voltage (L) is applied to the second node N2, a low voltage (L) is applied to the third node N3, a high voltage (H) is applied to the fourth node N4, the ninth transistor T9 is turned off, and the tenth transistor T10 starts being turned on, so the voltage at the output end (Out) is changed to the low voltage (VGL) from the high voltage (VGH) and is then output.

A section corresponding to section (b) is provided after section (f), and after this, the same operation is repeated as described above.

As a result, in the emitting signal stage, an emitting signal that is delayed than the control signal by a half clock period is output. That is, the carry signal applied to the emitting signal stage at the next end becomes to be delayed by a half clock period, so from among the output emitting signals, the timing for applying the high voltage (VGH) is delayed by a half clock period and is sequentially output.

Referring to FIG. 3, the third capacitor C3 included in the second second-node first controller 555-2 has a substantially large capacitance value, so when the clock signal applied to the second side of the third capacitor C3 is changed, the voltage at the first side, i.e., the voltage at the second node N2, is not substantially changed.

The third capacitor C3 has a structure in which the clock signal is connected to the capacitor, and the third capacitor C3 is connected to the first clock signal input end IN1. Therefore, from among the emitting signal stage, the capacitor connected to the first clock signal input end IN1 has an imbalance that it has a substantially large value compared to the second clock signal input end IN2. A capacitance difference between two input ends may be equal to or greater by sixty times depending on exemplary embodiments.

The number of emitting signal stages is half the number of the pixel rows, so it may be several hundreds. Further, when the first clock signal input end IN1 is connected to the same clock signal wire, several thousand times a capacitance difference is generated. The several thousand times a capacitance difference between the two clock signal input ends generates a problem that a static electricity inflow is transmitted to a specific clock signal wire, and a signal delay is generated at the specific clock signal.

However, in the present exemplary embodiment, as shown in FIG. 2, the pairs of wires 171 and 172, and 171-1 and 172-1, for clock signals applied to the respective sides of the display area 300, are alternately connected to the first clock signal input end IN1, so the capacitance difference between the pairs of wires for clock signals is very little or the same. That is, there is no capacitance difference between the two wires 171 and 172 for clock signals provided on the left of the display area 300, and there is no capacitance difference between the two wires 171-1 and 172-1 for clock signals provided on the right of the display area 300.

Figure 11:
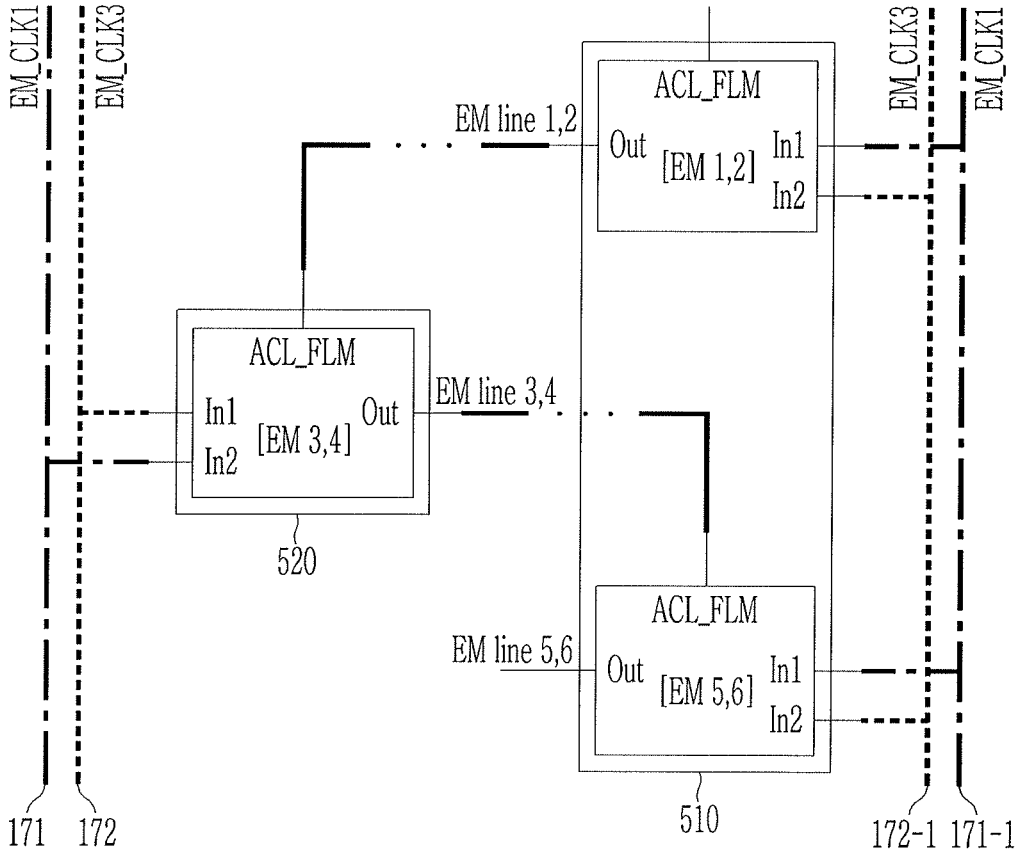
FIG. 11 illustrates an emitting signal generator according to a comparative example.

This will now be described through a comparative example shown in FIG. 11. FIG. 11 shows an emitting signal generator according to a comparative example. The comparative example of FIG. 11 and an exemplary embodiment of FIG. 2 will now be compared.

In the comparative example shown with reference to FIG. 11, emitting signal stages (EM) formed on the emitting signal generators 510 and 520 are alternately provided. That is, odd-numbered emitting signal stages (EM) are in the first emitting signal generator 510, and even-numbered emitting signal stage (EM) are in the second emitting signal generator 520. As a result, as shown in FIG. 11, the two wires 171 and 172 for clock signals provided on the left are connected to a predetermined clock signal input end. That is, the first clock signal wire 171 is connected to the first clock signal input end In1, and the second clock signal wire 172 is connected to the second clock signal input end In2. Further, the two wires 171-1 and 172-1 for clock signals provided on the right of the display area 300 are connected to the same clock signal input end.

In particular, all even-numbered emitting stages (EM) in the second emitting signal generator 520 receive the first clock signal (EM_CLK1) at the second clock signal input end In2 and the third clock signal (EM_CLK3) at the first clock signal input end In1, while all odd-numbered emitting stages (EM) in the first emitting signal generator 510 receive the first clock signal (EM_CLK1) at the first clock signal input end In1 and the third clock signal (EM_CLK3) at the second clock signal input end In2. When the first clock signal input end In1 has greater capacitance than the second clock signal input end In2, a specific clock signal wire connected to the first clock signal input end In1 also has great capacitance.

In contrast, in an exemplary embodiment shown with reference to FIG. 2, the emitting signal stage (EM) formed on the respective emitting signal generators 510 and 520 has two adjacent emitting signal stages (EM) in the same emitting signal generators 510 and 520. As a result, the clock signal wires are alternately connected to the first clock signal input end In1 and the second clock signal input end In2 for the two adjacent emitting signal stages (EM).

Difference between FIG. 11 and FIG. 2 is not just in the arrangement of the emitting signal stage (EM), but also with respect to the two pairs of wires for the clock signals 171 and 172, and 171-1 and 172-1. That is, in a comparative example shown with reference to FIG. 11, the pair of wires 171-1 and 172-1 for clock signals provided on the right of the display area 300 are connected to a specific clock signal input end for all emitting signal stages (EM) in the first emitting signal generator 510. That is, a first clock signal wire 171-1 for clock signals to which the first clock signal (EM_CLK1) is applied is connected to the first clock signal input end In1 of the emitting signal stage (EM) of the first emitting signal generator 510, and the second clock signal wire 172-1 for clock signals to which the third clock signal (EM_CLK3) is applied is connected to the second clock signal input end In2. Similarly, the pair of wires 171 and 172 for clock signals provided on the left of the display area 300 are connected to a specific clock signal input end, opposite that for the first emitting signal generator 5, for all emitting signal stages (EM) in the second emitting signal generator 520.

Referring to FIG. 3, the large capacitor C3 is connected to the first clock signal input end In1, so a load of the first clock signal wire 171-1 for clock signals is very much different from a load of the second clock signal wire 172-1 for clock signals. The above-noted structure is identically generated in the pair of wires 171 and 172 for clock signals provided on the left of the display area 300. A signal delay is generated to a first-side wire because of the difference of capacitance of the two pairs of wires 171 and 172, and 171-1 and 172-1, for clock signals, and the static electricity inflow is transmitted to the wire with lower capacitance.

That is, when the wire with lower capacitance is connected to one clock signal input end in the emitting signal stage (EM), static electricity flows to the corresponding clock signal wire, so drawbacks such as destruction by static electricity is generated at the corresponding clock signal input end.

However, when the two adjacent emitting signal stages (EM) are provided on the same emitting signal generators 510 and 520 regarding the emitting signal stage (EM) formed on the respective emitting signal generators 510 and 520 in a like manner of an exemplary embodiment shown with reference to FIG. 2, the wires 171, 172, 171-1, and 172-1 for clock signals are connected to the two clock signal input ends In1 and In2 of the two adjacent emitting signal stages (EM). As a result, capacitance between the two wires 171 and 172 for clock signals provided on the left of the display area 300 becomes the same, and capacitance between the two wires 171-1 and 172-1 for clock signals provided on the right of the display area 300 becomes the same. As described above, the loads between the two pairs of wires 171 and 172, and 171-1 and 172-1, for clock signals become equivalent, so the specific clock signal wire is not vulnerable to static electricity. In addition, the signal delay is not generated to the specific clock signal wire, but a uniform signal is applied. Further, the carry signal (emitting signal) output to the emitting signal stage (EM) at the next end by the emitting signal stage (EM) may be applied without passing through the display area 300, so the delay of the carry signal (emitting signal) is reduced.

Figure 12:
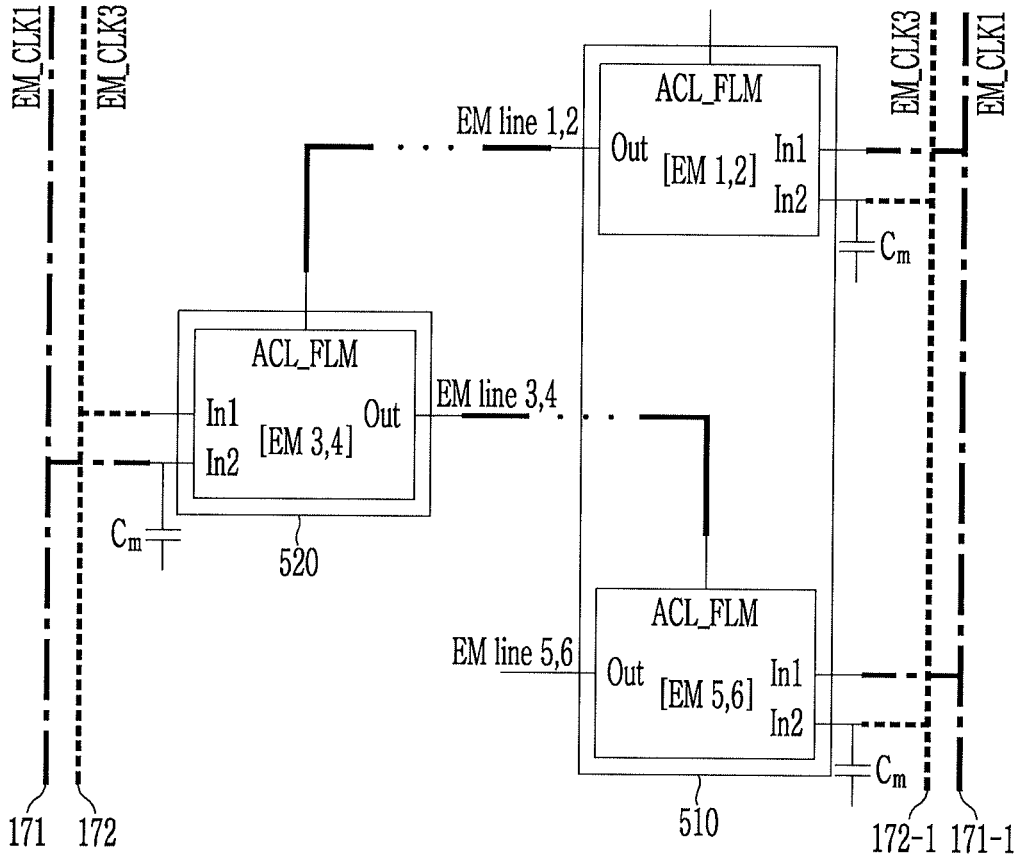
FIG. 12 illustrates an emitting signal generator according to an exemplary embodiment.

Another exemplary embodiment will now be described with reference to FIG. 12. FIG. 12 shows an emitting signal generator according to an exemplary embodiment. The exemplary embodiment shown with reference to FIG. 12 is an exemplary embodiment in which a matching capacitor (Cm) is added to the second clock signal input end In2 of the emitting signal stage (EM) in the structure of a comparative example shown with reference to FIG. 11.

In FIG. 12, the emitting signal stages (EM) formed on the respective emitting signal generators 510 and 520 are alternately provided. That is, odd-numbered emitting signal stages (EM) are in the first emitting signal generator 510, and even-numbered emitting signal stages (EM) are in the second emitting signal generator 520. As a result, as shown in FIG. 11, the two wires 171 and 172 for clock signals provided on the left are connected to a predetermined clock signal input end, and two wires 171-1 and 172-1 for clock signals provided on the right are connected to a predetermined clock signal input end. That is, the first clock signal wire 171 is connected to the first clock signal input end In1, and the second clock signal wire 172 is connected to the second clock signal input end In2.

Regarding the emitting signal stage (EM) of FIG. 12, the first clock signal input end In1 has higher capacitance than the second clock signal input end In2. However, in an exemplary embodiment shown with reference to FIG. 12, an additional matching capacitor (Cm) is connected to the second clock signal input end In2 to match the capacitance of the first clock signal input end In1 and the second clock signal input end In2.

As a result, when a specific clock signal wire is connected to a specific clock signal input end, no capacitance imbalance is generated. Therefore, a specific clock signal wire is not vulnerable to static electricity in the exemplary embodiment of FIG. 12. Further, no signal delay is generated to the specific clock signal wire and a uniform signal is applied.

In the exemplary embodiment shown with reference to FIG. 12, the matching capacitor (Cm) is added to the second clock signal input end In2 in the structure according to a comparative example shown with reference to FIG. 11. Similarly, a matching capacitor (Cm) may be added to the second clock signal input end In2 shown in FIG. 2.

By way of summation and review, in one or more embodiments, the load of the two clock signal wires connected to the stage included in the emitting signal generator is maintained, so when static electricity is generated, the same is prevented from being applied to the stage through a specific clock signal wire and damaging the stage. As a result, the operation of the emitting signal generator does not generate defects. In addition, no signal delay is generated to the specific clock signal wire, and the uniform signal is applied. Further, the emitting signal stage may be applied when the carry signal output as a next-end emitting signal stage does not pass through the display area, so the delay of the carry signal is reduced.

One or more embodiments provide an organic light emitting diode display including an emitting signal generator in respective sides of a display area for maintaining a load of a clock signal wire. One or more embodiments prevent static electricity from being generated when loads of two clock signal wires are different from being applied through a specific clock signal wire and damaging an emitting signal generator.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode display, comprising:

a display area including a pixel for receiving an emitting signal and emitting light in response thereto; and first and second emitting signal generators provided on respective sides of the display area, each of the first and second emitting signal generators including a plurality of emitting signal stages, wherein each of the plurality of emitting signal stages includes two clock signal input ends having different capacitance values, and a matching capacitor connected to the clock signal input end with lower capacitance from among the two clock signal input ends, the matching capacitor causing a capacitance of a first clock signal input end of the two clock signal input ends to match second clock signal input end of the two clock signal input ends.

2. The organic light emitting diode display as claimed in claim 1, wherein two adjacent emitting signal stages are included in a same one of the first and second emitting signal generators.

3. The organic light emitting diode display as claimed in claim 1, wherein two adjacent emitting signal stages are included in the first and second emitting signal generators, respectively.

4. The organic light emitting diode display as claimed in claim 1, wherein the emitting signal stages are respectively connected to n-numbered pixel rows, n being an integer that is equal to or greater than 1, and the n-numbered pixel rows emit light simultaneously.

5. An organic light emitting diode display, comprising:

a display area including a pixel for receiving an emitting signal and emitting light in response thereto; and first and second emitting signal generators provided on respective sides of the display area, each of the first and second emitting signal generators including a plurality of emitting signal stages, wherein each of the plurality of emitting signal stages includes two clock signal input ends having different capacitance values, and a matching capacitor connected to the clock signal input end with lower capacitance from among the two clock signal input ends, and two adjacent emitting signal stages are included in a same one of the first and second emitting signal generators.

6. An organic light emitting diode display, comprising:

a display area including a pixel for receiving an emitting signal and emitting light in response thereto; and first and second emitting signal generators provided on respective sides of the display area, each of the first and second emitting signal generators including a plurality of emitting signal stages, wherein each of the plurality of emitting signal stages includes two clock signal input ends having different capacitance values, and a matching capacitor connected to the clock signal input end with lower capacitance from among the two clock signal input ends, and two adjacent emitting signal stages are included in the first and second emitting signal generators, respectively.

* * * * *